United States Patent [19]

Bolliger

[11] B 3,998,139

[45] Dec. 21, 1976

[54] DRIVE MECHANISM FOR A MOVABLE PLATEN

[75] Inventor: Edwin Bolliger, Morges, Switzerland

[73] Assignee: J. Bobst & Fils, S.A., Switzerland

[22] Filed: Feb. 11, 1975

[21] Appl. No.: 548,978

[44] Published under the second Trial Voluntary Protest Program on March 9, 1976 as document No. B 548,978.

[30] Foreign Application Priority Data

Feb. 12, 1974 Switzerland ..... 2024/74

[52] U.S. Cl. ..... 93/58.3; 83/527

[51] Int. Cl.[2] ..... B26D 5/14; B31B 1/16

[58] Field of Search ..... 83/698, 699, 700, 627, 83/628, 629, 527, 248; 93/58.3, 58 R

[56] References Cited

UNITED STATES PATENTS

| | | | |
|---|---|---|---|
| 1,142,575 | 6/1915 | Inman | 93/58.3 X |
| 1,809,040 | 6/1931 | Husler | 83/700 X |
| 2,757,731 | 8/1956 | Musly | 83/527 |
| 2,833,349 | 5/1958 | Green | 83/699 X |
| 2,910,898 | 11/1959 | Martindell | 83/527 X |
| 3,111,054 | 11/1963 | Tishkin | 83/699 X |

*Primary Examiner*—James F. Coan
*Attorney, Agent, or Firm*—Hill, Gross, Simpson, Van Santen, Steadman, Chiara & Simpson

[57] ABSTRACT

A press having a frame with a fixed platen and a drive mechanism including two pairs of aligned crank shaft assemblies each having a bearing housing rotatably supporting an eccentric shaft with a connecting rod coupled to a movable platen to shift the platen relative to the fixed platen characterized by an adjusting device for each bearing housing which device can both independent and simultaneously adjust the distance of the bearing housing of each crank shaft assembly relative to the fixed platen to enable correcting orientation of the movable platen and to adjust the force and pressure of the press. In one embodiment of the adjustment mechanism, a pair of members having inclined planes are utilized. In another embodiment, a threaded shaft having a worm gear threaded thereon along with a pair of nuts is utilized for adjusting the position of the bearing housing relative to the fixed platen.

10 Claims, 5 Drawing Figures

II
II
1
2
3
4
5
6
7
9
10
11
12
13
14
15
16
17
18
19
20
21
22
22'
23
24
25
26
29
34
70
71
72
73
75
76
77
78

DRIVE MECHANISM FOR A MOVABLE PLATEN

BACKGROUND OF THE INVENTION

1. Field of the Invention

The present invention is directed to a press having a fixed platen and a drive means including a plurality of crank assemblies which reciprocate the movable platen relative to the fixed platen, and which press can have either the impression force between the fixed and movable platens or the orientation of the surface of the movable platen adjusted.

2. Prior Art

Presses or platen presses which have a fixed platen mounted in a frame and a drive mechanism for reciprocating a movable platen relative to the fixed platen are used for processing material in the form of sheets or webs, for example of die cut paper board or corrugated board into box or carton blanks. Usually the fixed platen is mounted on a frame above the movable platen and the drive mechanism includes a plurality of crank assemblies each having a connecting rod extending to the movable platen for reciprocating the movable platen vertically in the frame relative to the fixed platen. The upper dead-center position of the movable platen corresponds to the press working position. To die cut a box blank from a sheet, the lower surface of the fixed platen as well as the upper surface of the movable platen which are in facing relationship may each be equipped with cutting and creasing tools. For this reason, the plane of the upper surface or working surface of the movable platen must be perfectly parallel with the plane of the working or lower surface of the fixed platen. In addition, the impression force of the press is obtained by adjusting the spacing between the two working surfaces of the fixed and movable platen when in the press working position.

Previous proposed designs for platen presses have the drawback of not including a device enabling an easy orientation of the upper plane of the movable platen or bed with regard to the surface of the fixed platen. To obtain an adjustment of the impression force, these press designs used devices which acted on the fixed platens and were independent of the device for orientating the upper planes of the movable platen.

SUMMARY OF THE INVENTION

The present invention is directed to an improvement in a press which enables easy adjustments of both the orientation of the working or upper surface of the movable platen and the adjustments of the impression force between the movable and fixed platens. To accomplish these tasks, the press of the present invention has a frame, a fixed platen with a flat surface mounted on the frame, drive means disposed on the frame for reciprocating the movable platen having a flat surface in the frame relative to the fixed platen, said drive means including a main shaft having a gear, at least one crank shaft assembly disposed on each side of the main drive shaft, each crank shaft assembly having a bearing housing rotatably supporting an eccentric shaft having a gear and at least one connecting rod coupled to the movable platen, the gear of the drive shaft in driving engagement with the gear of each assembly on one side and driving the gear of each assembly on the opposite side through an intermediate gear, said frame including means for mounting each of the bearing housings thereon with the improvement comprising each of the means for mounting including means for adjusting the distance of each bearing housing from the fixed platen both independently and simultaneously with the adjusting of the distance of the other bearing housing so that orientation of the surface of the movable platen can be adjusted relative to the flat surface of the fixed platen and the force of impression of the press can be adjusted.

One embodiment of the adjusting means includes a threaded shaft extending between each housing and the frame which shaft has at least a pair of members threaded thereon. Preferably, one member threaded on the shaft is a worm gear and includes means for rotating two worm gears of adjacent adjustment means simultaneously. The individual adjustments is accomplished by the other threaded member of each shaft. In the preferred construction of this embodiment, the means for rotating the pairs of worm gears are interconnected so that all worm gears are rotated simultaneously.

In another embodiment of the invention, the adjustment means includes at least one member interposed between a first surface of each bearing housing and a second surface of the frame, said member having an inclined surface of an inclination coacting with one of the said first and second surfaces, said one surface being inclined at the same inclination so that relative movement of the inclined surfaces changes the distance of the bearing housing from the first platen. Preferably, the one surface is on a second member of a pair of members interposed between the frame and each housing, one of the pair of members is adjustably connected to the bearing housing so that separate movement provides individual adjustment of the respective bearing housing and simultaneous moving of the other or second member simultaneously adjusts the distance of all of the housings relative to the fixed platen. In the preferred embodiment of the press, four crank assemblies are provided in aligned pairs with one on each side of the drive shaft and includes a shifting means disposed on the frame for each two aligned assemblies for simultaneously moving said other or second members to simultaneously change the distance of the bearing housings of the two aligned assemblies from the fixed platen. Preferably, the press includes means interconnecting the shifting means so that all the second members are shifted simultaneously the same distance to simultaneously adjust the distance of all bearing housings relative to the fixed housing.

DESCRIPTION OF THE PREFERRED EMBODIMENTS

Figure 1:
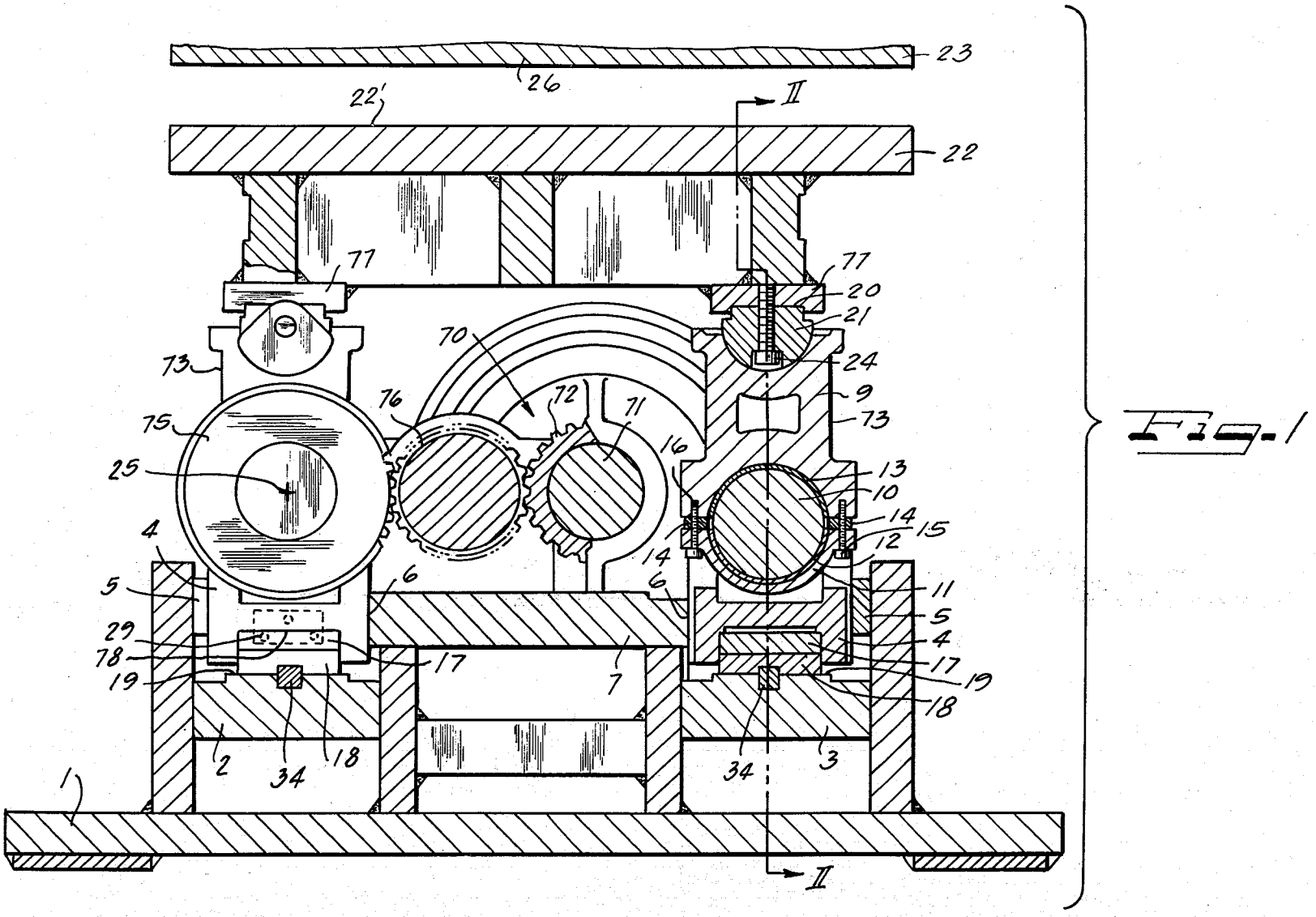
FIG. 1 is a cross-sectional view of a press according to the present invention illustrating one embodiment of the adjustment means.

The principles of the present invention are particularly useful in a press illustrated in FIG. 1.

The press has a frame 1 which is formed by a plurality of members interconnected by welded joints. These members forming the frame include a pair of parallel, horizontally extending members 2 and 3 which are each supported by members 37 and 38 (FIG. 3) and are spaced apart by a member 7 (FIG. 1). A fixed platen 23 having a flat surface 26, which is a working surface, is supported by vertically extending members (not illustrated) of the frame 1 above the members such as 2, 3 and 7. A drive means generally indicated at 70 is disposed on the frame and includes a main drive shaft 71 having a gear 72, at least one and preferably two, crank shaft assemblies 73 are disposed on each side of the drive shaft 71.

Figure 2:
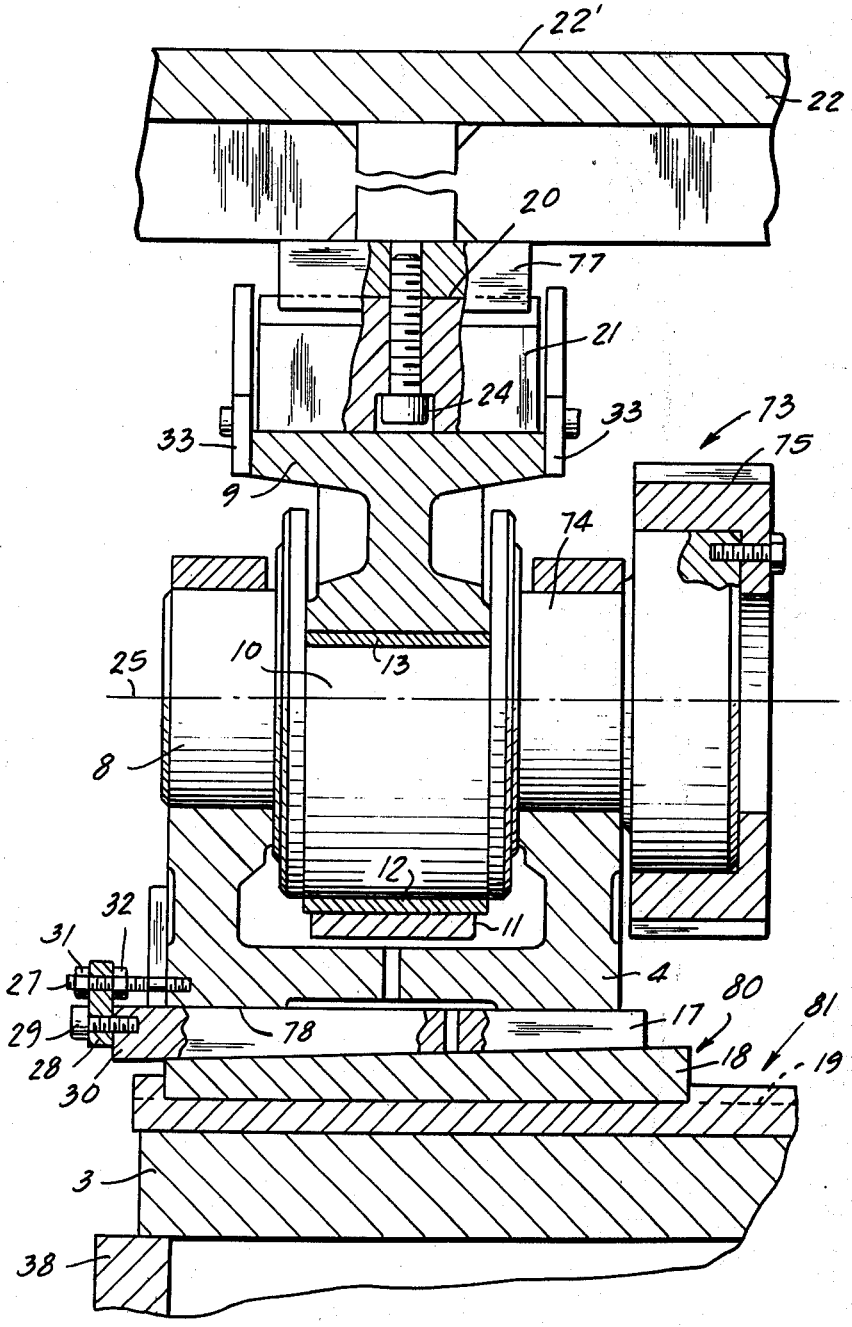
FIG. 2 is an enlarged cross-sectional view, which has portions broken away and portions in elevation for purposes of illustration, taken on line II-II of FIG. 1.

As best illustrated in FIG. 2 each crank shaft assembly 73 has a bearing housing or support bearing 4 which rotatably supports an eccentric shaft 74 which has a gear 75 on an axis 25 of rotation and has an eccentric portion or crank pin 10. The gear 72 of the drive shaft 71 (FIG. 1) is in driving engagement with the gears 75 of the assemblies 73 on the right-hand side of the frame 1 and will drive the gear 75 of the assembly 73 on the left-hand side through an intermediate gear 76 so that the rotation of the eccentric cranks on one side of the frame will be in the opposite direction to the rotation of the eccentric shafts on the opposite side.

As illustrated in FIGS. 1 and 2, each of the crank assemblies 73 has a connecting rod 9 which is rotatably received on the crank pin 10 and is coupled to a movable platen 22 having an upper surface 22′ which is a working surface. To rotatably mount the connecting rod 9 on the crank pin 10, a half bearing or strap 11 containing an insertion 12 coacts with the bearing insert 13 supported in the connecting rod 9. To attach the bearing or strap 11 to the connecting rod 9, threaded fasteners such as machine bolts 15 and 16 are used and to ensure proper spacing between inserts 12 and 13, spacing shims 14 are provided.

The movable platen 22 is a rigid construction having a plurality of welded members reinforcing the plate of the plate. On a lower surface of the movable platen, pads or plates 77 having a flat surface 20 are provided for each connecting rod 9. The coupling of each connecting rod 9 is accomplished through a toggle joint to this plate 77. As illustrated, the toggle joint is between an upper curved surface of a head of the connecting rod and a semi-cylindrical surface of a member 21 which is mounted to the surface 20 by a machine screw or bolt 25. The connecting rod 9 has a pair of side plates 30 which limit lateral movement in one direction between the connecting rod and the member 21 and which may be connected to the member 21. To prevent the rotation of the member 21 on the pad 77, the surface 20 is recessed between flanges (FIG. 1).

To support each of the crank assemblies 73 in the frame, the mounting means which includes a pair of members, first member 17 and second member 18, disposed between a flat surface 78 on each bearing housing 4 and a flat surface 19 on either the member 2 or the member 3 of the frame is utilized. In addition to prevent tilting of each bearing housing 4, a sliding shoe member 5 engages a side surface of the housing 4 while the opposite side surface is engaged by an end surface 6 of the frame member 7.

Each of the mounting means includes an adjustment means 80 which is formed by the pair of members 17 and 18. As best illustrated in FIG. 2, both the members 17 and 18 have a wedge-shaped configuration with a trapezoid shape in the longitudinal direction. The wedge shape provides each of the members 17 and 18 with an inclined surface which has the same inclination and which inclined surfaces coact together during relative movement of the members 17 and 18 to change the distance of the bearing housing 4 from the surface 26 of the fixed platen.

The first member 17, which has an upper surface engaging the surface 78 of the housing 4, is adjustably connected to the bearing housing 4 by adjustable connecting means. As illustrated in FIG. 2, the adjustable connecting means includes a threaded member or shaft 27 threadably received on the end of the housing 4 and extending through an aperture in a plate 28 which is attached to an end of the first member 17 by a pair of machine screws 29. The threaded member 27 is provided with fine threads and threadably receives a nut 31 and a counter-nut 32 which are disposed on each side of the plate 28. By selectively threading the nuts on the shaft 27, the first member 17 is shifted relatively along surface 78 of the housing and on the second member 18 to both change the distance of the surface 78 from surface 19 and change the distance of the housing 4 from the surface 26 of platen 23.

Figure 3:
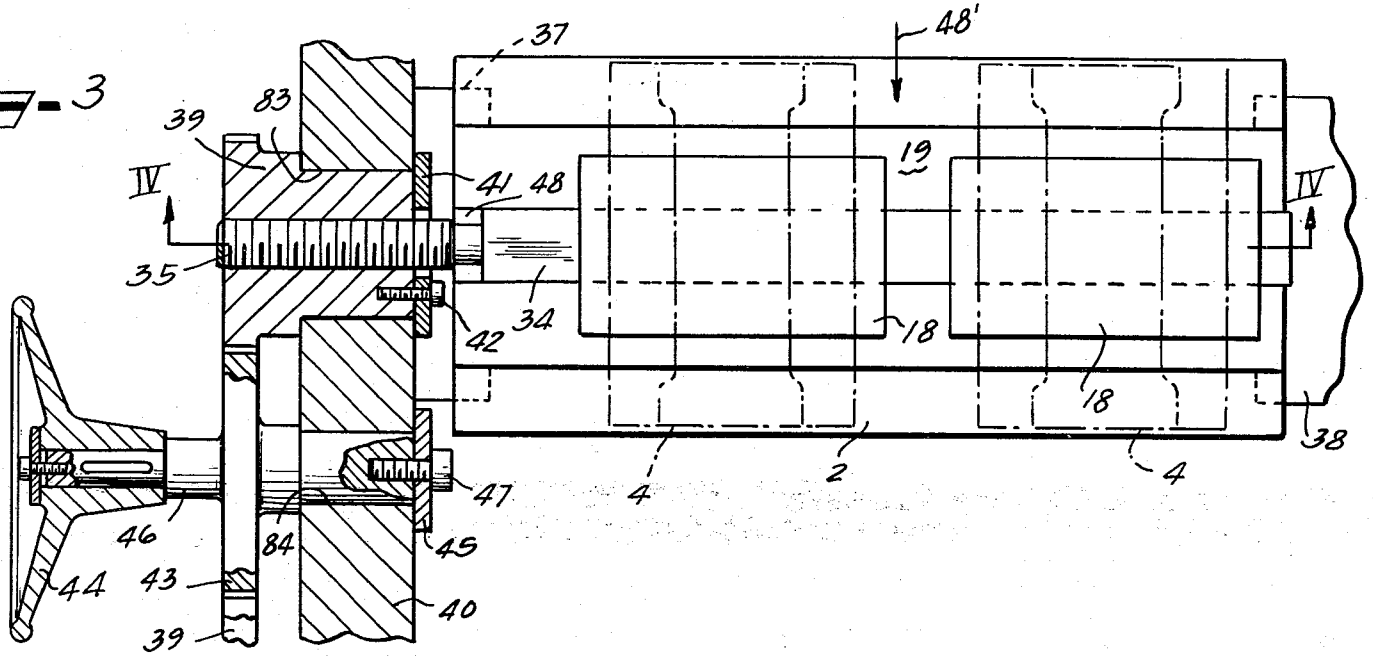
FIG. 3 is a top view, which has portions broken away, portions in cross section and portions in elevation for purposes of illustration, of a portion of the adjustment mechanism with aligned bearing housings shown in chain lines.
Figure 4:
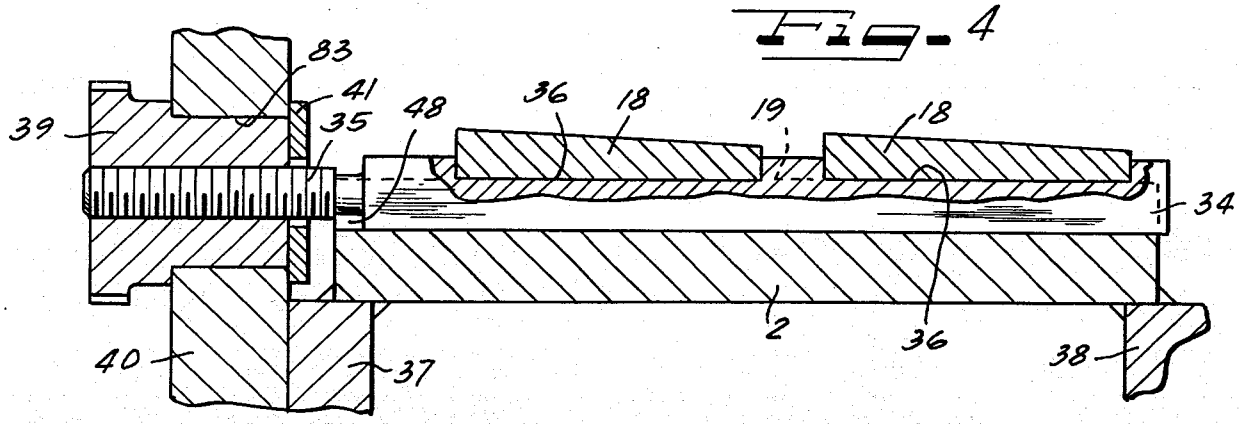
FIG. 4 is a cross-sectional view, which has portions broken away and portions in elevation for purposes of illustration, taken along lines IV—IV of FIG. 3.

To simultaneously change the distance between the surface 26 of the fixed platen 23 and the bearing housings 4 of a pair of aligned crank assemblies 73, which are aligned perpendicular to a direction 48′ of feed of the blanks through the press, each aligned pair of assemblies 73 is provided with shifting means 81. As illustrated in FIGS. 3 and 4, the shifting means 81 includes means for interconnecting the second members 18 of the aligned pair of housing 4, which means is illustrated as a square bar member 34 which has a threaded extension 35. The bar member 34 has spaced notches or recesses 36 and is received for sliding movement in a groove 48 in the surface 19 of each of the members 2 and 3 with the base of the notches 36 level with the surface 19. The second members 18 for the housings is received in the notches or recesses 36 so that relative movement of the bar 34 in the groove 48 simultaneously shifts the pair of second members 18 to adjust the distance between the associated pair of housings 4 relative to the fixed platen 23. The threaded extension 35 of the bar 34 extends through an aperture 83 in a frame member 40 and threadably receives a member 39 which is a gear member. The gear member 39 has a portion rotatably received in the aperture 83. To hold the member 39 in the aperture 83 and prevent axial shifting, a stop washer 41 is attached by one or more machine screws 42 to the member 39. Any rotation of the member 39 causes shifting the bar member 34 to simultaneously shift the two second members 18 engaged thereby.

As illustrated, the member 39 is provided with gear teeth which are in meshing engagement with a gear 43 that also is in engagement with another gear member 39 for the shifting means of the other aligned pair of housings. The gear member 43 has an axle 46 which receives a hand wheel 44 and other end of the axle 46 is received in an aperture 84 of the member 40 for rotation and held against axial shifting therein by a stop washer 45 attached by a machine screw 47. The gear member 43 forms an interconnecting linkage or means between the two shifting means 81 to simultaneously actuate both shifting means to simultaneously adjust all four of the second members 18 simultaneously. The interconnecting means can be provided with an interlocking device, which is not illustrated, to hold the hand wheel in any fixed position or setting. If the press is provided with a sensor to measure the impression pressure or force of the press, any desired force or pressure can be obtained by rotation of the hand wheel 44 to simultaneously move all of the lower or second members 18 to shift the position of all of the bearing housings 4 relative to the fixed platen to obtain the desired impression force.

In the above discussion, adjustments were directed to adjusting the position of each of the bearing housings 4 relative to the surface 26 of the fixed platen. A change in this distance will create the same change in the distance between the surface 20 and the surfaces 19.

The above described arrangement enables both individual adjustment of the position of the four bearing housings 4 to correct the orientation of the surface 22' of the movable platen 22 relative to the surface 26 of the fixed platen 23. The adjustment means also enables a simultaneous changing of the distance of the surface 22' from the surface 26 at the working position. These changes are necessary when changing the thickness of the sheet materials being processed by the press.

Figure 5:
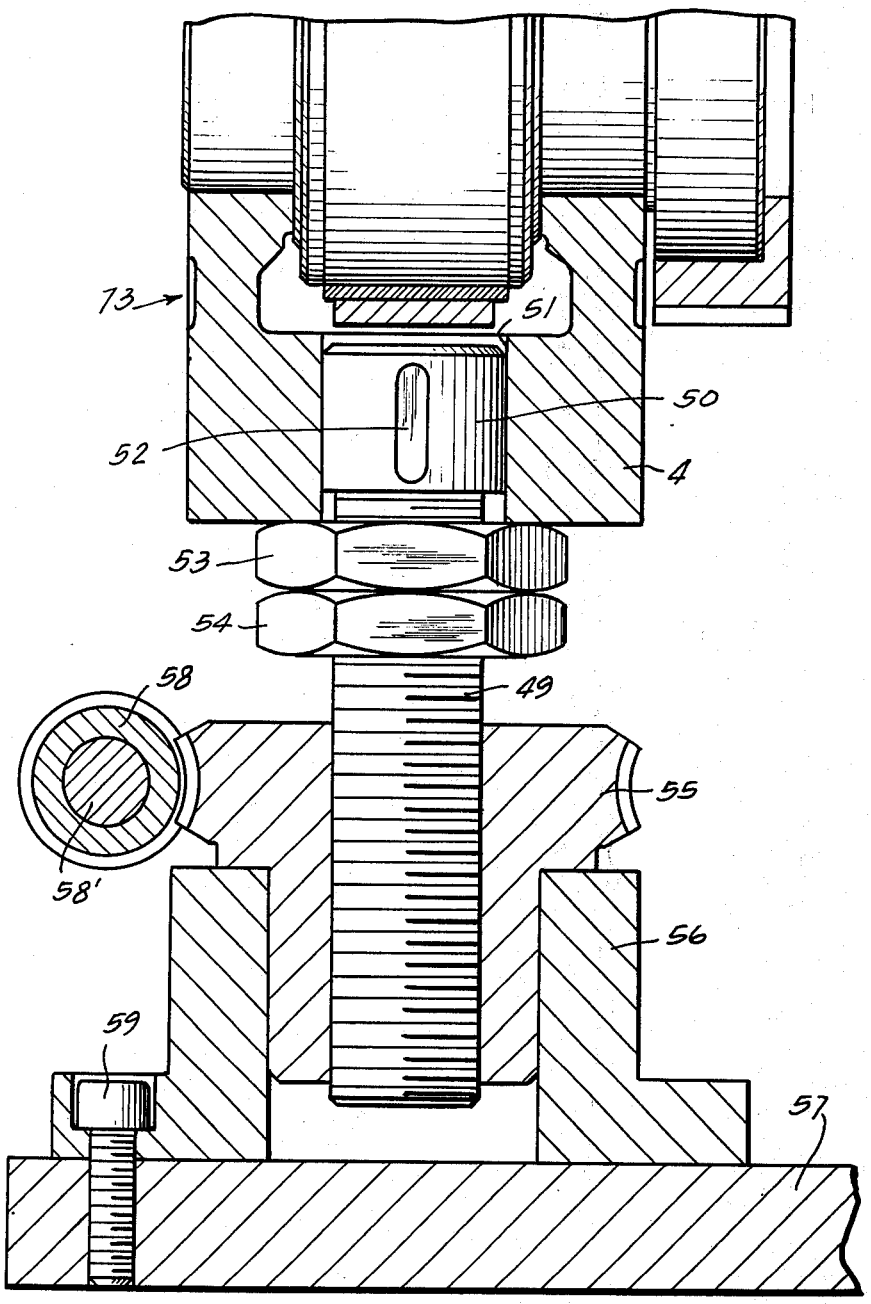
FIG. 5 is a cross-sectional view with portions in elevation of a second embodiment of adjustment means in accordance with the present invention.

FIG. 5 shows another embodiment of an adjusting means which enables both individual adjustment of the bearing housing such as 4 of each crank assembly 73 and simultaneous adjustment of all of the bearing housings. The embodiment utilizes a threaded member 49 which may be a threaded shaft or axle and which has a cylindrical head 50 received in a bore 51 of the bearing housing 4. To prevent relative rotation between the head 50 and the housing 4 but to allow axial shifting therebetween, the bore 51 has a groove which receives a key 52 which is carried by the head 50. A threaded member such as a nut 53 is threadably received on the shaft 49 and engages the lower surface 78 of the housing 4 to determine the axial position of the head 50 in the bore 51. A counter-nut 54 is also provided to secure the position of the nut 53. A threaded member, such as a worm gear 55, is threadably received on the shaft or member 49 and has a cylindrical bearing portion received in an upstanding cylindrical bearing 56 which is secured on a frame member 57 by a plurality of fastening means such as machine screws or bolts 59. It should be noted that in this embodiment, the frame does not include the parallel members 2 and 3 and that the member 57 may be a base plate of the frame 1 or disposed thereon. Rotation of the worm gear 55 is accomplished by a gear train comprising a worm gear 58 keyed to a shaft 58'. Preferably, the shaft 58' extends through the housing and has a similar worm gear 58 engaging a worm gear on an adjacent adjustment means so that rotation of the shaft 58' simultaneously rotates two worm gears 55 of adjacent adjustment means to vary the vertical distance of the housings 4 from the plate 57 and there in turn from the fixed platen 23. The shafts 58' may be interlinked by a gear arrangement such as used in the embodiment illustrated in FIG. 3. As illustrated, the shafts 58' extend transverse to the axis 25 of the eccentric shafts and parallel to the direction of movement 48'. Thus each shaft operates with a crank assembly in two different pairs. However, the shaft 58' can be oriented, if desired, to extend parallel to the axis 25 and thus drive the worm gear 55 of the adjustment means for the aligned pair of crank assemblies. With the means interconnecting the two shafts 58', rotation of the two shafts 58' will simultaneously adjust the distance of all four housings relative to the plate 57 and fixed platen 23. Individual adjustment of the distance of each of the bearing housings 4 from the fixed platen 23 is accomplished by rotating the adjustment nut 53 and the counter-nuts 54.

Although various minor modifications may be suggested by those versed in the art, it should be understood that I wish to employ within the scope of the patent granted hereon all such modifications as reasonably and properly come within the scope of my contribution to the art.

I claim:

1. In a press having a frame, a fixed platen with a flat surface mounted on the frame, drive means disposed in the frame for reciprocating a movable platen having a flat surface in the frame relative to the fixed platen, said drive means including a main drive shaft having a gear, at least one crank shaft assembly disposed on each side of the main drive shaft, each crank shaft assembly having a bearing housing rotatably supporting an eccentric shaft having a gear and at least one connecting rod coupled to the movable platen, the gear of said drive shaft being in driving engagement with the gear of each assembly on one side and driving the gear of each assembly on the opposite side through an intermediate gear, said frame including means for mounting each of the bearings thereon, the improvement comprising each of the means for mounting including means for adjusting the distance of each bearing housing from the fixed platen both independently and simultaneously with the adjusting of the distance of the other bearing housings so that the orientation of the surface of the movable platen can be adjusted relative to the flat surface of the fixed platen and the force of impression of the press can be adjusted.

2. In a press according to claim 1, wherein the means for adjusting each assembly includes at least one member interposed between a first surface of the bearing housing and a second surface of the frame, said member having an inclined surface of an inclination coacting with one of said first and second surfaces, said one surface being inclined at the same inclination so that the relative movement of the inclined surfaces changes the distance of the bearing housing from the fixed platen.

3. In a press according to claim 2, which includes means for imposing relative movement between the inclined surfaces of each assembly simultaneously.

4. In a press according to claim 1, wherein the means for adjusting each assembly includes a pair of members, interposed between a surface of the bearing housing and a surface of the frame, each of said pair of members having an inclined surface of the same inclination so that relative movement between said pairs of members changes the distance of the bearing housing from the fixed platen.

5. In a press according to claim 4, wherein the first member of the pair of members for each assembly is adjustably connected to the bearing housing and wherein the second member of the pair of members is interconnected by means for simultaneously imposing movement relative to the bearing housings so that separate movement of any of said first members provides individual adjustment of the respective bearing housing and simultaneous movement of the second members simultaneously adjust the distance of all housings relative to the fixed platen.

6. In a press according to claim 4, wherein two aligned crank assemblies are disposed on each side of the drive shaft, wherein the adjustment means for each crank assembly includes a first and second member interposed between a surface of the bearing housing for each assembly and a surface of the frame, each of said members having an inclined surface of the same inclination, means for adjustably connecting said first member to its respective bearing housing for relative movement thereto and shifting means disposed in the frame for each two aligned assemblies for simultaneously moving said second members to simultaneously change the distance of the bearing housing of the two aligned assemblies from the fixed platen so that independent movement of any of said first members independently adjusts the distance of the respective bearing housing relative to the fixed platen and movement of the shifting means simultaneously adjusts the distance of the bearing housings on one side relative to the fixed platen.

7. In a press according to claim 6, which further includes means interconnecting the shifting means so that all of the second members are shifted simultaneously the same relative distance to simultaneously adjust the distance of all the bearing housings relative to the fixed platen.

8. In a press according to claim 1, wherein the means for adjusting each bearing housing includes a threaded shaft extending between each bearing housing and the frame, each shaft having at least two members threaded thereon so that movement of the members on each threaded shaft changes the distance between the respective housing and frame.

9. In a press according to claim 1, wherein two aligned crank assemblies are disposed on each side of the drive shaft, wherein the adjustment means for each crank assembly includes a threaded shaft extending between the bearing housing and the frame, each threaded shaft having a pair of nuts threaded thereon and a worm gear thread thereon, and wherein the frame receives a pair of gear trains, each gear train engaging the worm gears of a pair of adjustment means so that actuation of each gear train simultaneously adjusts the distance between each associated bearing housing and the fixed platen and the distance of each housing from the fixed platen can be individually adjusted by rotation of the pair of nuts.

10. In a press according to claim 9, wherein the pair of gear trains are interconnected so that the distance between each housing and the fixed platen can be simultaneously adjusted.

* * * * *